US008322721B2

(12) United States Patent
Colston

(10) Patent No.: US 8,322,721 B2
(45) Date of Patent: Dec. 4, 2012

(54) MEDIA DISPENSER

(75) Inventor: Scott L. Colston, Dundee (GB)

(73) Assignee: NCR Corporation, Duluth, GA (US)

( * ) Notice: Subject to any disclaimer, the term of this patent is extended or adjusted under 35 U.S.C. 154(b) by 246 days.

(21) Appl. No.: 12/609,519

(22) Filed: Oct. 30, 2009

(65) Prior Publication Data

US 2011/0101594 A1 May 5, 2011

(51) Int. Cl.
*B65H 29/20* (2006.01)

(52) U.S. Cl. ..... 271/315; 271/314

(58) Field of Classification Search ..... 271/4.01, 271/4.02, 3.14–3.16, 314, 315
See application file for complete search history.

(56) References Cited

U.S. PATENT DOCUMENTS 3,966,198 A * 6/1976 Komada et al. ..... 271/265.02
3,994,487 A * 11/1976 Wicklund ..... 271/314
4,342,325 A * 8/1982 Lundblad ..... 221/7
4,603,849 A * 8/1986 Nakamura et al. ..... 271/186
4,881,731 A * 11/1989 Simpson-Davis ..... 271/315
5,156,385 A * 10/1992 Muto et al. ..... 271/3.2
5,192,067 A * 3/1993 Saito ..... 271/10.03
6,494,447 B2 * 12/2002 Myer, Sr. ..... 271/176
7,871,068 B2 * 1/2011 Yamazaki ..... 271/10.03
2005/0017428 A1 * 1/2005 Ichikawa et al. ..... 271/3.14
2008/0136096 A1 * 6/2008 Crerar ..... 271/306
2011/0304091 A1 * 12/2011 Hirano et al. ..... 271/3.14

FOREIGN PATENT DOCUMENTS

JP 03195649 A * 8/1991

* cited by examiner

*Primary Examiner* — Prasad Gokhale
(74) *Attorney, Agent, or Firm* — Michael Chan; Paul W. Martin

(57) ABSTRACT

A media dispenser comprises: a pick unit arranged to pick individual sheets under control of a pick unit motor; a transport section arranged to transport each picked sheet; a stacker wheel arranged to collate transported sheets under control of a stacker wheel motor; and a controller including a counter. The controller is arranged to (i) enable selectively the pick unit motor and the stacker wheel motor, (ii) provide a first step signal to both the pick unit motor and an input to the counter, and (iii) provide an output from the counter as a second step signal to the stacker wheel motor.

9 Claims, 2 Drawing Sheets

MEDIA DISPENSER

FIELD OF INVENTION

The present invention relates to an improved media dispenser.

BACKGROUND OF INVENTION

Media dispensers transport sheets of media from a container to a media presenter. One common type of media dispenser is a currency dispenser. One type of currency dispenser comprises: (i) a pick unit that picks individual banknotes, (ii) a transport section that transports the picked banknote, (iii) a stacker wheel having radially-spaced, arcuate tines that receives and bunches picked banknotes, and (iv) a presenter unit that presents the bunched banknotes.

The stacker wheel receives a picked banknote between adjacent radially-spaced tines and is then rotated by a motor to receive the next picked banknote. The received banknotes are then stripped out of the stacker wheel by a stripping arm, and presented as a bunch of banknotes to the presenter unit.

One problem associated with this type of stacker wheel is that the operation of the pick unit (in particular, the pick arm within the pick unit) needs to be synchronized with the rotation of the stacker wheel so that the stacker wheel tines do not obstruct a picked banknote as it is transported into the stacker wheel.

One way of synchronizing the stacker wheel and the pick arm is to link the stacker wheel motor to the pick unit motor by gears or belts. However, these gears or belts may have to be decoupled to allow the transport section to be opened to provide access to any jammed banknotes therein. This would require the gears or belts to be correctly aligned and synchronized after the jammed banknote has been cleared and the transport section is closed, which would increase service time. If this is not done correctly, then there would be an increased risk of a banknote colliding with one of the tines on the stacker wheel.

An improved synchronization mechanism is desirable.

SUMMARY OF INVENTION

Accordingly, the invention generally provides methods, systems, apparatus, and software for controlling motors in an electromechanical device.

In addition to the Summary of Invention provided above and the subject matter disclosed below in the Detailed Description, the following paragraphs of this section are intended to provide further basis for alternative claim language for possible use during prosecution of this application, if required. If this application is granted, some aspects of the invention may relate to claims added during prosecution of this application, other aspects may relate to claims deleted during prosecution, other aspects may relate to subject matter never claimed. Furthermore, the various aspects detailed hereinafter are independent of each other, except where stated otherwise. Any claim corresponding to one aspect should not be construed as incorporating any element or feature of the other aspects unless explicitly stated in that claim.

According to a first aspect there is provided a media dispenser comprising: a pick unit arranged to pick individual sheets under control of a pick unit motor; a transport section arranged to transport each picked sheet; a stacker wheel arranged to collate transported sheets under control of a stacker wheel motor; and a controller including a counter, the controller being arranged to (i) enable selectively the pick unit motor and the stacker wheel motor, (ii) provide a first step signal to both the pick unit motor and an input to the counter, and (iii) provide an output from the counter as a second step signal to the stacker wheel motor.

By providing selective control of each of the pick unit motor and the stacker wheel motor, each motor can be moved individually and independently of the other to a reset position for that motor (also referred to as a home position). This enables the controller to move the motors to their respective reset positions prior to operation to ensure that the two motors are synchronized. This also ensures that if the pick unit motor or the stacker wheel motor is operated individually, for example, by a service engineer to test the operation of that motor, then the controller can automatically re-synchronies the pick unit motor and the stacker wheel motor.

The home position for the stacker wheel may be related to the length of the transport section, the speed at which banknotes are transported, and the number of tines in the stacker wheel.

The value of the counter may be related to the required gearing between the pick unit motor and the stacker wheel motor, the length of the transport section, and the number of tines in the stacker wheel.

The controller may be arranged to change the counter value between a plurality of values so that a non-integer division is possible. For example, the second step signal may be a divide by "n" signal for one (or more) pulse(s) then a divide by "n+1" signal for the next pulse.

The counter may be incremented (from zero) until the desired counter value is reached, or decremented (from the desired counter value) until zero is reached.

The sheets may comprise banknotes, tickets, passes, coupons, or the like.

The media dispenser may comprise a currency dispenser, a currency recycler, a ticket dispenser, or the like.

By virtue of this aspect of the invention, the controller is operable to increment (or decrement) a counter by one count for each pulse on the first step signal. If the pick unit motor is enabled, then each of these pulses also advances the pick unit motor by a single step. When the counter reaches its final value, then a single pulse is provided for advancing the stacker wheel motor by a single step. The controller thereby provides a divide by "n" counter. By providing a plurality of different desired counter values, where different counter values can be used for successive second step signals, the average value of "n" is not restricted to an integer.

According to a second aspect there is provided a method of controlling a media dispenser comprising: (i) selectively enabling each of a pick unit motor and a stacker wheel motor, and moving each motor to its respective reset position; (ii) providing a first step signal to both the pick unit motor and an input to a counter; and (iii) providing an output from the counter to the stacker wheel motor as a second step signal.

The method may further comprise loading a first value into the counter so that one pulse for the second step signal is generated when the first value has been decremented to zero; and loading a second value (different from the first value) into the counter so that another pulse for the second step signal is generated when the second value has been decremented to zero.

According to a third aspect there is provided a self-service terminal including the media dispenser of the first aspect.

The self-service terminal may be an automated teller machine (ATM), an information kiosk, a financial services center, a bill payment kiosk, a lottery kiosk, a postal services machine, a check-in and/or check-out terminal such as those used in the retail, hotel, car rental, gaming, healthcare, and airline industries, and the like.

According to a fourth aspect there is provided a method of controlling a plurality of motors, the method comprising: (i) selectively enabling one of the plurality of motors; (ii) moving the selected motor to a reset position for that motor; (iii) repeating the steps of selectively enabling and moving a motor until all of the plurality of motors have been moved to their respective reset positions; (iv) providing a first step signal to one of the plurality of motors and an input to a counter; and (v) providing an output from the counter to another of the plurality of motors as a second step signal.

The plurality of motors may be used in a media dispenser. Alternatively, the plurality of motors may be used in a different electro-mechanical system.

According to a fifth aspect there is provided a method of controlling a media dispenser comprising: (i) selectively enabling a pick unit motor; (ii) moving the pick motor to a reset position for the pick unit motor; (iii) selectively enabling a stacker wheel motor; (iv) moving the stacker wheel motor to a reset position for the stacker wheel motor; (v) receiving a command to pick a plurality of media items; (vi) providing a first step signal to both the pick unit motor and an input to a counter; (vii) providing an output from the counter to the stacker wheel motor as a second step signal; and repeating steps (vi) and (vii) until the plurality of media items have been dispensed.

For clarity and simplicity of description, not all combinations of elements provided in the aspects of the invention recited above have been set forth expressly. Notwithstanding this, the skilled person will directly and unambiguously recognize that unless it is not technically possible, or it is explicitly stated to the contrary, the consistory clauses referring to one aspect of the invention are intended to apply mutatis mutandis as optional features of every other aspect of the invention to which those consistory clauses could possibly relate.

These and other aspects will be apparent from the following specific description, given by way of example, with reference to the accompanying drawings.

DETAILED DESCRIPTION

Figure 1:
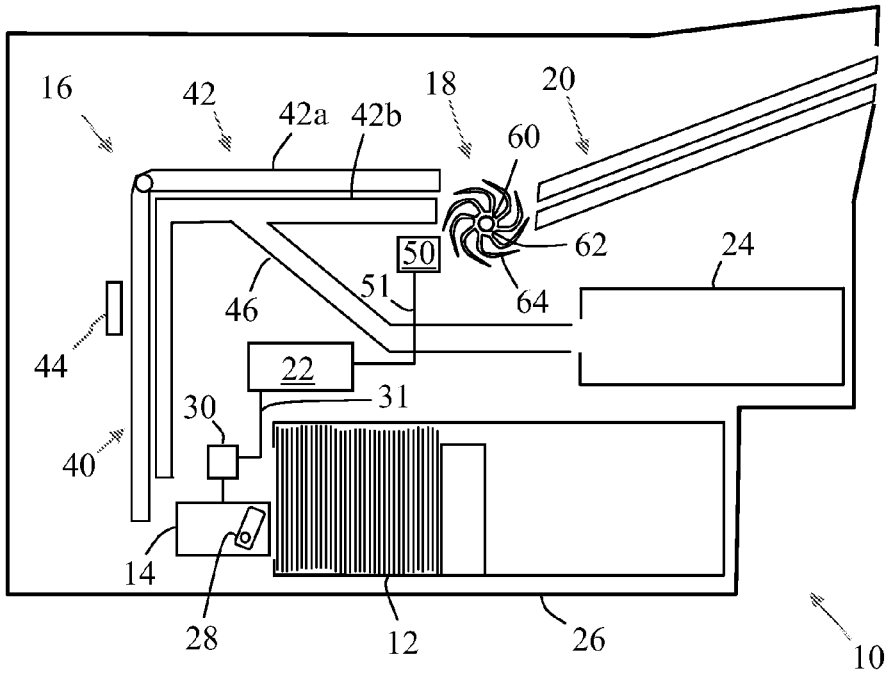
FIG. 1 is a schematic diagram of a media dispenser according to one embodiment of the present invention.

Reference is now made to FIG. 1, which is a block diagram of a media dispenser 10, in the form of a banknote dispenser.

The banknote dispenser 10 comprises: a removable currency cassette 12; a pick unit 14; a transport section 16; a stacker wheel 18; a presenter unit 20; a controller 22, and a purge bin 24. These components are all housed within a chassis 26.

The pick unit 14 includes a pivoting pick arm 28 coupled to a pick unit motor 30. The pick unit motor 30 is coupled to the controller 22 by a control line 31.

The pick arm 28 has a reset position (also referred to as the home position) at which the pick arm 28 is aligned for picking a banknote from the currency cassette 12. The pick arm 28 includes a sensor (not shown) for indicating to the controller 22 when the pick arm 28 is correctly oriented at the home position.

The transport section 16 comprises a vertical portion 40 for receiving a picked banknote from the pick unit 14, and a horizontal portion 42 for conveying a picked banknote either to the stacker wheel 18 or to the purge bin 24. The vertical portion 40 includes a conventional banknote thickness sensor 44 to detect multiple superimposed banknotes being transported erroneously as a single banknote. Any such superimposed banknotes may be diverted to the purge bin 24 via a divert path 46. The horizontal portion 42 comprises an upper guide 42*a* pivotably coupled to a lower guide 42*b* to permit access to any banknote jammed therebetween so that the jammed banknote can be removed therefrom. The lower guide 42*b* includes a diverter (not shown) for routing a banknote (or multiple banknotes) to the divert path 46.

The transport section 16 includes belts and/or gears to transport banknotes, and these belts and/or gears are all powered by the pick unit motor 30.

The stacker wheel 18 is coupled to a stacker wheel motor 50. The stacker wheel motor 50 is coupled to the controller 22 by a control line 51.

The stacker wheel 18 comprises an axle 60, on which are mounted a plurality of mutually coupled but axially separated hubs 62 (only one of which is shown in FIG. 1). Each hub 62 includes a plurality of arcuate tines 64 disposed transverse to the axle 60 on which the hubs 62 are mounted. The hubs 62 are mounted in registration so that the arcuate tines 64 on one hub 62 are aligned with the corresponding arcuate tines 64 on all other hubs 62.

The hubs 62 are rotated in unison as banknotes are fed towards the stacker wheel 18 from the transport section 16. The rotation of the stacker wheel 18 is synchronized with the speed at which banknotes are conveyed so that only one banknote is stored between adjacent tines 64 on a hub 62.

Figure 2:
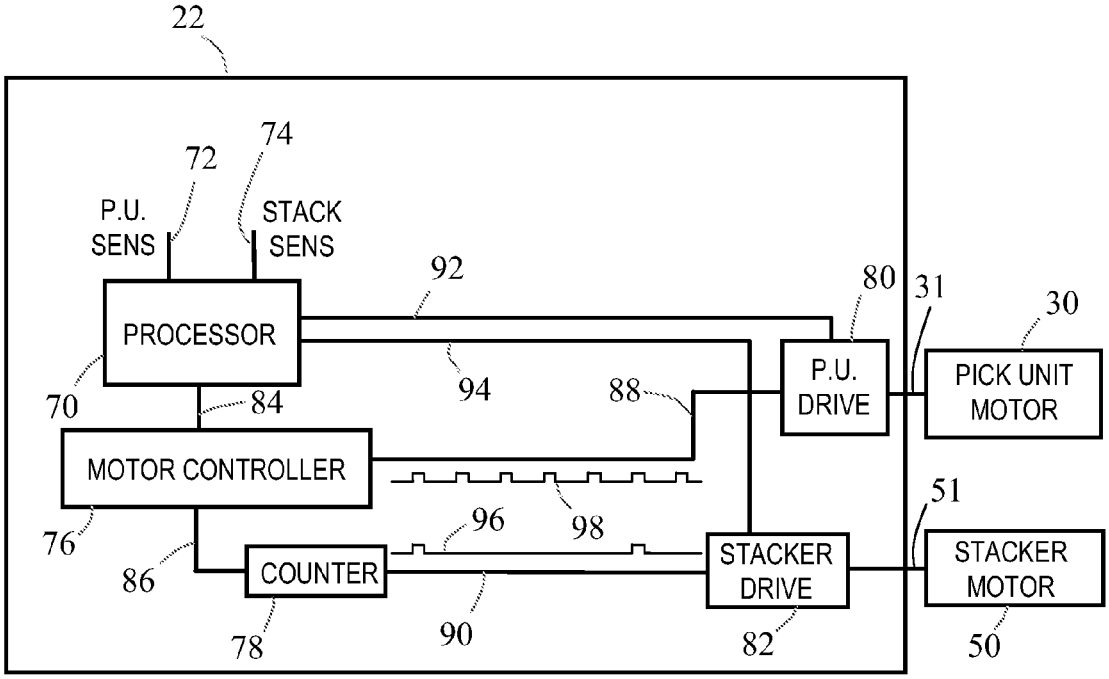
FIG. 2 is a block diagram showing a part (a controller) of the media dispenser of FIG. 1 in more detail.

Reference is now also made to FIG. 2, which is a block diagram illustrating the controller 22 in more detail.

The controller 22 comprises a processor 70; a pick unit sensor line 72; a stacker wheel sensor line 74; a motor controller 76; a counter 78; a pick unit drive 80; and a stacker wheel drive 82.

The processor 70 is coupled to the motor controller 76 by a control line 84, which the processor 70 uses to transmit control information to the motor controller 76. The control information includes motor rotation direction (forward or reverse) and pulse frequency information (the pulse width being constant). The motor controller 76 uses this control information to generate a series of pulses on both an intermediate line 86 and a first step signal line 88, where the series of pulses have a frequency corresponding to that received from the processor 70. The intermediate line 86 inputs this generated series of pulses to the counter 78. The counter 78 decrements its current value by one for each pulse received on the intermediate line 86, and generates a pulse on a second step signal line 90 when the counter's final value is reached.

The controller 22 includes a pick enable line 92 linking the processor 70 to the pick unit drive 80. The pick enable line 92 is used for conveying an enable signal from the processor 70 to enable operation of the pick unit motor 30. Provided the pick enable line 92 is active, the pick unit motor 30 will advance by a single step per pulse on the first step signal line 88.

The controller 22 also includes a stacker enable line 94 linking the processor 70 to the stacker wheel drive 82. The stacker enable line 94 is used for conveying an enable signal from the processor 70 to enable operation of the stacker wheel motor 50. Provided the stacker enable line 94 is active, the stacker wheel motor 50 will advance by a single step per pulse on the second step signal line 90.

In this embodiment, the counter 78 is loaded with an initial value "n" by the processor 70, as will be described below. For each pulse on the intermediate line 86, the counter 78 decrements by one. When the counter 78 reaches zero, it generates a pulse on the second step signal line 90. FIG. 2 illustrates, by way of example, a second signal 96 (propagated on the second step signal line 90) generated by the counter 78 in response to a first signal 98 (propagated on the first step signal line 88) when the initial value of the counter is five (that is, when n=5).

Each pulse of the first signal 98 causes the pick unit drive 80 to move the pick unit motor 30 by one step in the direction indicated by the control information. Similarly, each pulse of the second signal 96 causes the stacker wheel drive 82 to move the stacker wheel motor 50 by one step in the direction indicated by the control information.

Initially, the processor 70 loads the selected value of n into the counter 78. The selected value of n is calculated from a gear ratio. The gear ratio refers to a hypothetical embodiment where the pick unit motor 30 is directly coupled by gears to the stacker wheel motor 50. In such a hypothetical embodiment, the gear ratio is the ratio of gear teeth on the pick unit motor 30 to gear teeth on the stacker wheel motor 50. In general, the gear ratio is represented by equation (1) below:

$$\text{Gear ratio}=X:Y \tag{1}$$

In embodiments where X is an integer and Y is one (for example, 8:1), then n equals X (that is, n="8" for this example). However, in embodiments where this is not the case (that is, when Y="1" and X is not an integer), then more than one value of n is required. To calculate the values of n, the following equations are used. Values resulting from these equations are shown herein in inverted commas. In the following equations the values of X and Y are multiplied as required to ensure that both X and Y are integers.

The number of pulses required at the lower value of n (NLS) is given by equation (2) below.

$$\text{Number of low } n \text{ steps (NLS)}=Y-1 \tag{2}$$

The ratio of pulses on the first signal 98 to the second signal 96 for the low value of n is given by equation (3) below.

$$\text{Ratio of pulses for low } n \text{ (RLN)}=\text{FLOOR}(X/Y) \tag{3}$$

Where FLOOR means rounded down.

The number of pulses required at the higher value of n is always set to "1" in this embodiment, as shown in equation (4) below.

$$\text{Number of high } n \text{ steps (NHS)}=1 \tag{4}$$

The ratio of pulses on the first signal 98 to the second signal 96 for the high value of n (RHN) is given by equation (5) below.

$$\text{RHN}=\text{FLOOR}(X/Y)+(X-(Y*\text{FLOOR}(X/Y))) \tag{5}$$

The values of n should then be n=RLN for NLS pulses of the second signal 96, then n=RHN for one pulse of the second signal 96.

Figure 3:
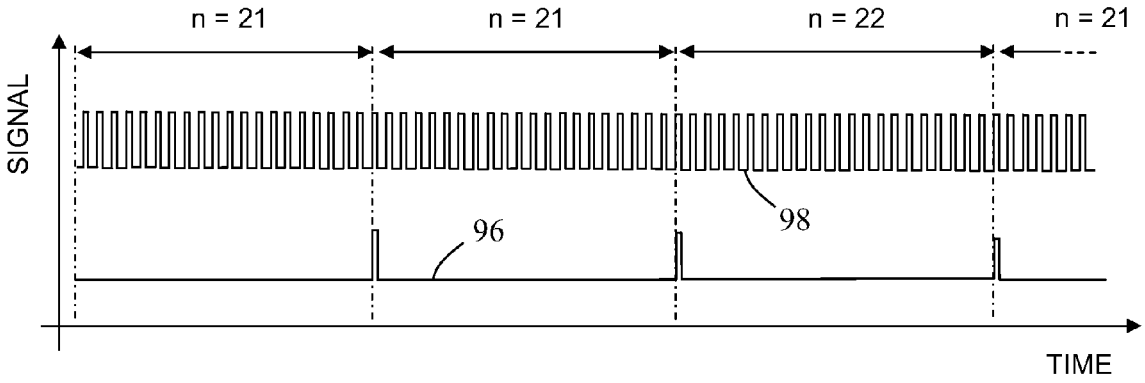
FIG. 3 is a timing diagram illustrating two pulses generated by the controller of FIG. 2.

In this embodiment, the gear ratio is 64:3. Applying these values to equation (2) above yields NLS="2"; equation (3) yields RLN="21"; equation (5) yields RHN="22". Thus, n="21" for "2" pulses, then "22" for "1" pulse. This means that the processor 70 loads the counter 78 with the value of "21" until this is decremented to zero, then the processor loads the counter 78 with the value of "21" again, until it is decremented to zero. However, on the third occasion, the processor 70 loads the counter 78 with the value "22". This sequence is repeated by the processor 70, so that every third re-load of the counter 78 is to the value of "22" rather than "21", as illustrated in FIG. 3. This ensures that for a non-integer value of gear ratio, the stacker wheel 18 does not creep out of synchronization with the pick unit 14 over time.

Using the counter 78 to divide the first signal 98 by n to generate the second signal 96 ensures that the two motors 30,50 remain synchronized, but prior to this, each motor 30,50 must be initialized by moving it to its home (or reset position).

The processor 70 initializes each of the motors 30,50 independently. The processor 70 implements this by enabling the pick enable line 92 and disabling the stacker enable line 94. The processor 70 then slowly rotates the pick unit motor 30 (via the motor controller 76 and the pick unit drive 80) until the pick unit sensor line 72 changes state. This change of state indicates that the pick arm sensor (not shown) detects the pick arm 28 in the home position. If the processor 70 advances the pick unit motor 30 too far, then it can reverse the direction of the pick unit motor 30 until the pick arm 28 is located at the home position.

The processor 70 then disables the pick enable line 92 and enables the stacker enable line 94. The processor 70 then slowly rotates the stacker wheel motor 50 (via the motor controller 76, the counter 78, and the stacker drive 82) until the stacker wheel sensor line 74 changes state. This change of state indicates that the stacker wheel sensor (not shown) detects the stacker wheel 18 in the home position. If the processor 70 advances the stacker wheel motor 50 too far, then it can reverse the direction of the stacker wheel motor 50 until the stacker wheel 18 is located at the home position.

Once the pick unit 14 and stacker wheel 18 have been independently moved to their respective home positions, the processor 70 enables both the pick enable line 92 and the stacker enable line 94 so that both motors 30,50 will move together, but by different amounts (based on the counter value) until the required number of banknotes (as requested by a customer) have been picked, collated, and then presented by the presenter unit 20.

It should now be appreciated that this embodiment has the advantages that no mechanical gears, belts, or pulleys are required to couple the pick unit motor 30 to the stacker wheel motor 50 to keep the two motors in phase. This reduces the wear and torque of the dispenser 10. This also only requires one motor controller to control the two motors 30,50, but still provides independent control of each motor 30,50. The embodiment also provides automated resetting of the pick arm 28 and stacker wheel 18, without requiring any human intervention, thereby avoiding human error.

Various modifications may be made to the above described embodiment within the scope of the invention, for example, in other examples, the motors may control different moving parts than those described.

In other embodiments, the counter 78 may increment to the selected value rather than decrement from the selected value. The counter is incremented until a first value is reached so that a pulse for the second step signal is generated when the first value has been reached. The counter is reset. The counter is incremented again until a second value is reached, different from the first value, so that a pulse for the second step signal is generated when the second value has been reached. Additional Boolean logic may be provided to generate the required pulse at the output of the counter 78.

In other embodiments, the controller may be used in an electro-mechanical system other than a media dispenser.

The steps of the methods described herein may be carried out in any suitable order, or simultaneously where appropriate. The methods described herein may be performed by software in machine readable form on a tangible storage medium or as a propagating signal.

The terms "comprising", "including", "incorporating", and "having" are used herein to recite an open-ended list of one or more elements or steps, not a closed list. When such terms are used, those elements or steps recited in the list are not exclusive of other elements or steps that may be added to the list.

Unless otherwise indicated by the context, the terms "a" and "an" are used herein to denote at least one of the elements, integers, steps, features, operations, or components mentioned thereafter, but do not exclude additional elements, integers, steps, features, operations, or components.

What is claimed is:

1. A media dispenser comprising:

a pick unit arranged to pick individual sheets under control of a pick unit motor;

a transport section arranged to transport each picked sheet;

a stacker wheel arranged to collate transported sheets under control of a stacker wheel motor; and a controller including a counter, the controller being arranged to (i) enable selectively the pick unit motor and the stacker wheel motor, (ii) provide a first step signal to both the pick unit motor and an input to the counter, and (iii) provide an output from the counter as a second step signal to the stacker wheel motor.

2. A media dispenser according to claim 1, wherein the value of the counter is related to a required gearing between the pick unit motor and the stacker wheel motor.

3. A media dispenser according to claim 1, wherein the sheets comprise banknotes.

4. A self-service terminal including the media dispenser of claim 1.

5. A self-service terminal according to claim 4, wherein the self-service terminal comprises an automated teller machine.

6. A method of controlling a media dispenser comprising:

(i) selectively enabling each of a pick unit motor and a stacker wheel motor, and moving each motor to its respective reset position;

(ii) providing a first step signal to both the pick unit motor and an input to a counter, and (iii) providing an output from the counter to the stacker wheel motor as a second step signal.

7. A method according to claim 6, wherein the method comprises the further step of repeating the steps until all requested sheets have been picked and presented to a customer.

8. A method according to claim 6, wherein the method further comprises loading a first value into the counter so that one pulse for the second step signal is generated when the first value has been decremented to zero; and loading a second value, different from the first value, into the counter so that another pulse for the second step signal is generated when the second value has been decremented to zero.

9. A method according to claim 6, wherein the method further comprises incrementing the counter until a first value is reached so that a pulse for the second step signal is generated when the first value has been reached; resetting the counter; and incrementing the counter again until a second value is reached, different from the first value, so that a pulse for the second step signal is generated when the second value has been reached.

* * * * *